US012644163B2

(12) United States Patent
Azuma et al.

(10) Patent No.: US 12,644,163 B2
(45) Date of Patent: Jun. 2, 2026

(54) STEEL SHEET FOR GAS SOFT NITRIDING

(71) Applicant: NIPPON STEEL CORPORATION, Tokyo (JP)

(72) Inventors: Masafumi Azuma, Tokyo (JP); Shinya Saitoh, Tokyo (JP); Eisaku Sakurada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 474 days.

(21) Appl. No.: 18/037,045

(22) PCT Filed: Feb. 18, 2022

(86) PCT No.: PCT/JP2022/006696
§ 371 (c)(1),
(2) Date: May 15, 2023

(87) PCT Pub. No.: WO2022/176984
PCT Pub. Date: Aug. 25, 2022

(65) Prior Publication Data

US 2023/0416856 A1 Dec. 28, 2023

(30) Foreign Application Priority Data

Feb. 18, 2021 (JP) ..... 2021-024185

(51) Int. Cl.
*C21D 8/02* (2026.01)
*C21D 6/00* (2006.01)
(Continued)

(52) U.S. Cl.
CPC ..... *C21D 8/0257* (2013.01); *C21D 6/002* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0278* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS

2017/0130318 A1 5/2017 Taniguchi et al.

FOREIGN PATENT DOCUMENTS

JP 4462264 B2 5/2010
WO WO 2015/190618 A1 12/2015

*Primary Examiner* — Jenny R Wu
(74) *Attorney, Agent, or Firm* — Birch, Stewart, Kolasch & Birch, LLP

(57) ABSTRACT

This steel sheet for gas soft nitriding has a predetermined chemical composition and metallographic structure, in which, when a sheet thickness is indicated as t, a sheet width, which is a width in a direction perpendicular to a rolling direction, is indicated as w, and effective grain sizes are measured at seven positions of w/8, w/4, 3w/8, w/2, 5w/8, 3w/4, and 7w/8 in a width direction from an end portion in the width direction at a t/4 depth position from a surface, an average effective grain size, which is an average of the effective grain sizes at the seven positions, is 8.0 to 35.0 μm, and an effective grain size difference, which is a difference between a maximum value and a minimum value among the effective grain sizes at the seven positions, is 10.0 μm or less.

3 Claims, 1 Drawing Sheet

(51) Int. Cl.

| | |
|---|---|
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/42*** | (2006.01) |
| ***C22C 38/50*** | (2006.01) |
| ***C22C 38/60*** | (2006.01) |

(52) U.S. Cl.

CPC ..... *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/42* (2013.01); *C22C 38/50* (2013.01); *C22C 38/60* (2013.01); *C21D 2211/005* (2013.01)

STEEL SHEET FOR GAS SOFT NITRIDING

TECHNICAL FIELD OF THE INVENTION

The present invention relates to a steel sheet for gas soft nitriding.

Priority is claimed on Japanese Patent Application No. 2021-024185, filed Feb. 18, 2021, the content of which is incorporated herein by reference.

RELATED ART

Components that transmit power around an engine repeatedly undergo contact, friction, and loads between the components. Therefore, extremely high durability and wear resistance are required. In order to exhibit this performance, these components are often subjected to a surface-hardening treatment such as a carburizing hardening treatment or a nitriding treatment. Among these components, a gas soft nitriding treatment is applied to a surface-hardening treatment of a component made of a thin iron sheet. This gas soft nitriding treatment is, for example, a treatment performed at a high temperature in an atmosphere containing carbon together with nitrogen, so that a diffusion rate of nitrogen is high, and a predetermined hardness property can be obtained within a short treatment time. In addition, a treatment temperature is in a temperature range in which a steel material does not undergo austenitic transformation (generally 500° C. or higher and an Ac3 temperature or lower), so that a change in component dimensions or shapes (hereinafter, collectively referred to simply as a shape change) due to the treatment is smaller than that due to other treatments such as the carburizing hardening treatment. When the shape change due to the surface-hardening treatment is small, a shape accuracy of the component can be easily improved.

The shape accuracy of the component is an important requirement for assembly, and is also a property that strongly affects the durability and wear resistance of the component. This is because a slight shape distortion increases a contact area or a contact pressure between components when the components are used.

This shape change during the surface-hardening treatment occurs not only during a final cooling of the surface-hardening treatment but also during a heating process until the treatment temperature is reached. This shape change of the component during the heating and the cooling is caused not only by thermal expansion and contraction but also by the release of residual stress introduced during blank trimming or pressing, which are pre-steps of the surface-hardening treatment, during the heating. As described above, since changes in dimensions and shapes due to the surface-hardening treatment are affected not only by treatment conditions of the surface-hardening treatment but also by conditions of the blank trimming and the pressing, which are the pre-steps, it is not clear how to minimize the changes.

As described above, in the gas soft nitriding treatment, the shape change is smaller than that due to other surface-hardening treatments. However, since the shape change is caused by various factors, a certain shape change may occur even in a case where the gas soft nitriding treatment is performed. In addition, in a case where such a shape change is expected to occur and the expectation of the shape change can be predicted, a press shape (a pressing die shape) can be modified in advance to a shape different from a final product in consideration of the expectation of the shape change. However, in a case where an (unpredictable) shape change occurs due to the surface-hardening treatment, the current situation is that only subsequent measures such as performing shape straightening after the surface-hardening treatment (for example, shape straightening or discarding of those that cannot be easily straightened) are taken. That is, even in the gas soft nitriding treatment, which is generally said to have a small shape change, it is a fact that an economic loss in industrial production is caused by the shape change due to the surface-hardening treatment.

Regarding a steel sheet for a gas soft nitriding treatment, for example, Patent Document 1 discloses a method of manufacturing a cold-rolled steel sheet for a nitriding treatment, in which steel containing, as a composition, by mass %, C: more than 0.01% and 0.09% or less, Si: 0.005% to 0.5%, Mn: 0.01% to 3.0%, Al: 0.005% to 2.0%, Cr: 0.50% to 4.0%, P: 0.10% or less, S: 0.01% or less, N: 0.010% or less, and a remainder including Fe and unavoidable impurities, is hot-rolled at a finish temperature of 870° C. or higher, pickled, cold-rolled, and then subjected to recrystallization annealing at a temperature of 800° C. to 950° C. to control a grain boundary area Sv per unit volume to 80 $mm^{-1}$ or more and 1300 $mm^{-1}$ or less.

Patent Document 2 discloses a steel sheet for a soft nitriding treatment, in which the steel sheet contains, as a chemical composition, by mass %, C: 0.02% or more and less than 0.07%, Si: 0.10% or less, Mn: 1.1% to 1.8%, P: 0.05% or less, S: 0.01% or less, Al: 0.10% to 0.45%, N: 0.01% or less, Ti: 0.01% to 0.10%, Nb: 0% to 0.1%, Mo: 0% to 0.1%, V: 0% to 0.1%, Cr: 0% to 0.2%, and a remainder: Fe and impurities, $Mn+Al \geq 1.5$ is satisfied, a total amount of Ti, Nb, Mo, V, and Cr present as precipitates in the steel sheet is less than 0.03% by mass %, and the steel sheet has a metallographic structure in which an area ratio of ferrite is 80% or more, and a dislocation density of ferrite at a position 50 μm away from a surface of the steel sheet is $1\times10^{14}$ to $1\times10^{16}$ $m^{-2}$.

PRIOR ART DOCUMENT

Patent Document

[Patent Document 1] Japanese Patent No. 4462264

[Patent Document 2] PCT International Publication No. WO2015/190618

DISCLOSURE OF THE INVENTION

Problems to be Solved by the Invention

An object of Patent Document 1 is to propose an advantageous method of manufacturing a cold-rolled steel sheet for a nitriding treatment, in which a sufficient surface hardening ability and a hardening depth can be obtained by the nitriding treatment. In addition, Patent Document 2 is intended to improve fatigue properties that are not sufficient in the related art without lowering productivity and costs, and an object of Patent Document 2 is to provide a soft nitriding-treated steel having excellent workability before a soft nitriding treatment and having high fatigue properties by being subjected to a soft nitriding treatment.

That is, in neither of Patent Documents 1 and 2, suppression of the shape change due to the surface-hardening treatment is not taken into consideration.

As described above, in the related art, a technique for suppressing a shape change in a surface-hardening treatment such as a gas soft nitriding treatment by controlling a chemical composition and microstructures of a steel sheet has not been proposed.

An object of the present invention is to provide a steel sheet for gas soft nitriding capable of reducing the amount of shape change in a case where a gas soft nitriding treatment is performed as a surface-hardening treatment.

Means for Solving the Problem

As described above, since changes in dimensions and shapes due to the surface-hardening treatment are affected not only by the treatment conditions of the surface-hardening treatment but also by the conditions of the blank trimming (hereinafter, also referred to as "trimming") and the pressing, which are the pre-steps, it is not clear how to minimize the changes. In order to solve the problems, the present inventors considered that it is effective to first clarify and improve factors that cause shape changes in each of the trimming and pressing steps and the surface-hardening treatment.

In the trimming and pressing steps, it is considered that it is effective to revise an intermediate shape or adjust a blank holding force to introduce plastic strain by tension or the like so as to reduce residual stress in each intermediate forming step until a final shape is obtained, and furthermore, it is effective to improve a pressing technique, such as increasing position accuracy in a step subsequent to an intermediate formed product. In addition, in the latter surface-hardening treatment step, it is considered effective to increase uniformity of a temperature in a treatment furnace, to strictly manage a cooling rate in a final cooling step, and the like. However, such improvements are premised on the fact that materials subjected to the pressing or the surface-hardening treatment always behave in the same manner, and it is considered that, in practice, the shape changes occur even if the above-described conditions are made uniform.

The present inventors investigated shape changes of various steel sheets before and after a gas soft nitriding treatment. As a result, it was newly found that, in a steel sheet having a predetermined chemical composition and a metallographic structure, an effective grain size difference in a width direction (sheet width direction) causes a shape change. In addition, in order to reduce the effective grain size difference and suppress the shape change due to the gas soft nitriding treatment, it is effective to control conditions such as heating conditions before hot rolling and hot rolling conditions.

The present invention has been made based on the above findings. The gist of the present invention is as follows.

[1] A steel sheet for gas soft nitriding according to an aspect of the present invention includes, as a chemical composition, by mass %: C: 0.02% to 0.10%; Si: 0.001% to 0.100%; Mn: 0.70% to 1.65%; P: 0.060% or less; S: 0.005% or less; sol. Al: 0.020% to 0.450%; Ti: 0.020% to 0.120%; Cr: 0.100% to 0.450%; N: 0.0003% to 0.0070%; Cu: 0% to 0.40%; Ni: 0% to 0.30%; Nb: 0% to 0.080%; V: 0% to 0.080%; Mo: 0% to 0.100%; B: 0% to 0.0020%; Ca: 0% to 0.0100%; REM: 0% to 0.0100%; Sn: 0% to 0.0300%; Sb: 0% to 0.0100%; As: 0% to 0.0100%; Mg: 0% to 0.0300%; and a remainder including Fe and impurities, in which Formulas (1) and (2) are satisfied, a metallographic structure of the steel sheet for gas soft nitriding contains, by area %, ferrite: 30.0% to 100.0%, martensite: 0% to 5.0%, bainite: 0% to 70.0%, retained austenite: 0% to 3.0%, and pearlite: 0% to 3.0%, when a sheet thickness is indicated as t, a sheet width, which is a width in a direction perpendicular to a rolling direction, is indicated as w, and effective grain sizes are measured at seven positions of w/8, w/4, 3w/8, w/2, 5w/8, 3w/4, and 7w/8 in a width direction from an end portion in the width direction at a t/4 depth position from a surface, an average effective grain size, which is an average of the effective grain sizes at the seven positions, is 8.0 to 35.0 μm, and an effective grain size difference, which is a difference between a maximum value and a minimum value among the effective grain sizes at the seven positions, is 10.0 μm or less.

$$[\text{sol. Al}]+[\text{Cr}]\leq 0.482 \quad \text{Formula (1)}$$

$$94<64\times[\text{Mn}]+156\times[\text{Cr}]+190\times[\text{sol. Al}]-9\times[\text{Mn}]^2-86\times[\text{Cr}]^2-328\times[\text{sol. Al}]^2 \quad \text{Formula (2)}$$

where [element symbol] is an amount of an element represented by the element symbol by mass %.

[2] The steel sheet for gas soft nitriding according to [1] may contain, as the chemical composition, by mass %, one or two or more selected from the group consisting of: Cu: 0.01% to 0.40%; Ni: 0.01% to 0.30%; Nb: 0.001% to 0.080%; V: 0.001% to 0.080%; Mo: 0.001% to 0.100%; B: 0.0001% to 0.0020%; Ca: 0.0001% to 0.0100%; REM: 0.0001% to 0.0100%; Sn: 0.0001% to 0.0300%; Sb: 0.0001% to 0.0100%; As: 0.0001% to 0.0100%; and Mg: 0.0001% to 0.0300%.

[3] In the steel sheet for gas soft nitriding according to [1] or [2], a No. 5 test piece according to JIS Z 2241:2011 may have a tensile strength of 370 MPa or more and an elongation of 13.0% or more.

Effects of the Invention

According to the above aspect of the present invention, it is possible to provide a steel sheet for gas soft nitriding capable of reducing an amount of shape change in a case where a gas soft nitriding treatment is performed as a surface-hardening treatment on the premise that generally required tensile strength, elongation, and bendability are provided.

EMBODIMENTS OF THE INVENTION

Figure 1:
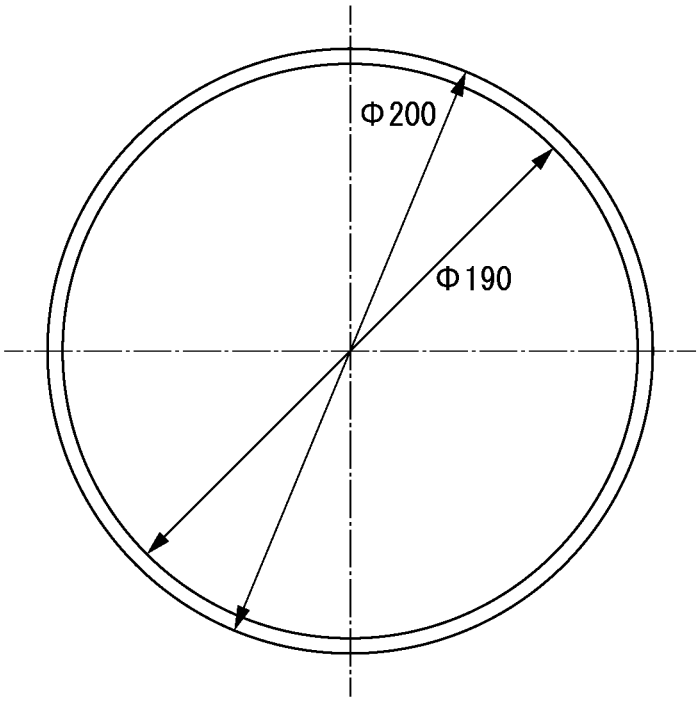
FIG. 1 is a diagram showing a shape of a test piece in a shape change investigation test.

Hereinafter, a steel sheet for gas soft nitriding according to an embodiment of the present invention (hereinafter, referred to as a steel sheet for gas soft nitriding according to the present embodiment), a method of manufacturing the same, and a gas-soft nitrided component obtained from the steel sheet for gas soft nitriding according to the present embodiment (a gas-soft nitrided component according to the present embodiment) will be described in detail. However, the present invention is not limited to configurations disclosed in the present embodiment, and various modifications can be made without departing from the gist of the present invention.

<Steel Sheet for Gas Soft Nitriding>

The steel sheet for gas soft nitriding according to the present embodiment has a predetermined chemical composition, in which a metallographic structure contains, by area %, ferrite: 30.0% to 100.0%, martensite: 0% to 5.0%, and bainite: 0 to 70.0%, retained austenite: 0% to 3.0%, and pearlite: 0% to 3.0%, when a sheet thickness is indicated as t, a sheet width, which is a width in a direction perpendicular to a rolling direction, is indicated as w, and effective grain sizes are measured at seven positions of w/8, w/4, 3w/8, w/2, 5w/8, 3w/4, and 7w/8 in a width direction from an end portion in the width direction at a t/4 position (a t/4 depth position from a surface) from a surface in a sheet thickness direction, an average effective grain size, which is an average of the effective grain sizes at the seven positions, is 8.0 to 35.0 μm, and an effective grain size difference, which is a difference between a maximum value and a minimum value among the effective grain sizes at the seven positions, is 10.0 μm or less.

Hereinafter, the reasons for limiting each of the above will be described.

(Chemical Composition)

First, the chemical composition of the steel sheet for gas soft nitriding according to the present embodiment will be described. In a numerical limitation range described below with the "to" in between, values at both ends are included in the range as a lower limit and an upper limit. Numerical values indicated as "less than" or "more than" do not fall within a numerical range. Unless otherwise specified, "%" for a chemical composition refers to "mass %".

C: 0.02% to 0.10%

C is an element that affects a strength of the steel sheet. In a case where a C content is less than 0.02%, a strength generally required for a steel sheet for gas soft nitriding cannot be sufficiently secured. Therefore, the C content is set to 0.02% or more. The C content is preferably 0.03% or more, and more preferably 0.04% or more or 0.05% or more.

On the other hand, in a case where the C content is more than 0.10%, elongation decreases. Therefore, the C content is set to 0.10% or less. The C content is preferably 0.08% or less, and more preferably 0.07% or less or 0.06% or less.

Si: 0.001% to 0.100%

Si is an element that forms a scale pattern on a surface of the steel sheet. Pickling is generally performed to remove the scale pattern. However, when a Si content is more than 0.100%, a pickling cost becomes significantly high. Therefore, the Si content is set to 0.100% or less. The Si content is preferably 0.085% or less or 0.070% or less, and more preferably 0.055% or less or 0.040% or less.

On the other hand, in order to reduce the pickling cost, the lower the Si content is, the more preferable it is. However, in a case where the Si content is set to less than 0.001%, a raw material cost is high. Therefore, the Si content is set to 0.001% or more. The Si content is preferably 0.003% or more or 0.005% or more, and more preferably 0.008% or more or 0.015% or more.

Mn: 0.70% to 1.65%

Mn is an element that increases a density of nitrides after a gas soft nitriding treatment when Mn is contained in combination with Cr and Al, and thus has an effect of improving wear resistance of a steel sheet after the gas soft nitriding treatment (including the gas-soft nitrided component, the same applies hereinafter). When a Mn content is less than 0.70%, nitrides having a sufficient density cannot be obtained after the gas soft nitriding treatment. Therefore, the Mn content is set to 0.70% or more while satisfying Formula (2) described later. The Mn content is preferably 0.80% or more or 0.85% or more, and more preferably 0.90% or more or 1.00% or more.

On the other hand, when the Mn content is more than 1.65%, an area ratio of ferrite in the metallographic structure decreases, and the elongation decreases. Therefore, the Mg content is set to 1.65% or less. The Mn content is preferably 1.60% or less or 1.50% or less, and more preferably 1.40% or less or 1.30% or less.

P: 0.060% or Less

P is an element (impurity) that is mixed in a manufacturing process of the steel sheet for gas soft nitriding. When a P content is high, grain boundaries become embrittled, so that cracking is likely to occur during the manufacturing of the steel sheet for gas soft nitriding. Therefore, the P content is set to 0.060% or less. The P content is preferably 0.040% or less or 0.030% or less, and more preferably 0.020% or less or 0.015% or less. The lower the P content is, the more preferable it is, and the P content may be 0%. However, the P content may be 0.001% or more or 0.003% or more in consideration of a dephosphorization cost.

S: 0.005% or Less

S is an element (impurity) that is mixed in the manufacturing process of the steel sheet for gas soft nitriding. In a case where a S content is high, MnS is formed, and cracking is likely to occur during press forming. Therefore, the S content is set to 0.005% or less. The S content is preferably 0.004% or less, and more preferably 0.003% or less. The lower the S content is, the more preferable it is, and the S content may be 0%. However, the S content may be 0.001% or more or 0.002% or more in consideration of a desulfurization cost.

Sol. Al: 0.020% to 0.450%

Al is an element that increases the density of the nitrides after the gas soft nitriding treatment when Al is contained in combination with Cr and Mn, and thus has an effect of improving the wear resistance of the steel sheet after the gas soft nitriding treatment.

When a sol. Al (acid-soluble Al) content is less than 0.020%, coarsening of austenite grain sizes during slab heating cannot be prevented, and as a result, there is a concern that the effective grain sizes in the width direction of the steel sheet vary widely. Therefore, the sol. Al content is set to 0.020% or more while satisfying Formulas (1) and (2) described later. The sol. Al content is preferably 0.030% or more, 0.040% or more, 0.060% or more, or 0.090% or more, and more preferably 0.200% or more.

On the other hand, when the sol. Al content is more than 0.450%, nozzle clogging is likely to occur during continuous casting, and productivity is lowered. Therefore, the sol. Al content is set to 0.450% or less. The sol. Al content is preferably 0.400% or less or 0.300% or less, and more preferably 0.200% or less or 0.150% or less.

Ti: 0.020% to 0.120%

Ti is an element that forms a Ti carbide and contributes to an improvement in the strength of the steel sheet, and is an element that has an effect of refining the effective grain sizes by refining the austenite grain sizes in a hot rolling step. When a Ti content is less than 0.020%, the effective grain size cannot be sufficiently refined. Therefore, the Ti content is set to 0.020% or more. The Ti content is preferably 0.025% or more or 0.035% or more, and more preferably 0.045% or more or 0.055% or more.

On the other hand, when the Ti content is more than 0.120%, the elongation decreases. Therefore, the Ti content is set to 0.120% or less. The Ti content is preferably 0.110% or less or 0.100% or less, and more preferably 0.080% or less or 0.070% or less.

Cr: 0.100% to 0.450%

Cr is an element that increases the density of the nitrides after the gas soft nitriding treatment when Cr is contained in combination with Mn and Al and thus has an effect of improving the wear resistance of the steel sheet after the gas soft nitriding treatment. When a Cr content is less than 0.100%, nitrides having a sufficient density cannot be obtained after the gas soft nitriding treatment. Therefore, the Cr content is set to 0.100% or more while satisfying Formulas (1) and (2) described later. The Cr content is preferably 0.120% or more or 0.140% or more, and more preferably 0.160% or more or 0.190% or more.

On the other hand, when the Cr content is more than 0.450%, the density of the nitrides after the gas soft nitriding treatment becomes excessively high. Therefore, the Cr content is set to 0.450% or less. The Cr content is preferably 0.400% or less, 0.350% or less, or 0.300% or less, and more preferably 0.250% or less or 0.220% or less.

N: 0.0003% to 0.0070%

N is an element that forms a coarse nitride and causes embrittlement cracking in a slab. Therefore, a N content is set to 0.0070% or less. The N content is preferably 0.0050% or less, or 0.0040% or less.

On the other hand, the lower the N content is, the more preferable it is. However, N is an element that is mixed in the manufacturing process of the steel sheet for gas soft nitriding, and in a case where the N content is set to less than 0.0003%, costs increase significantly. Therefore, the N content is set to 0.0003% or more. The N content is preferably 0.0005% or more, or 0.0010% or more.

Formula (1) and Formula (2)

In the above components, the sol. Al content and the Cr content are set to be in ranges of Formula (1) and Formula (2), and the Mn content is limited to a range of Formula (2). In a case where a left side of Formula (1) is more than 0.482, in the steel sheet (including a case where the steel sheet is a component) after the gas soft nitriding treatment, an effective hardening depth, which is a depth (distance from the surface) of a region in which a hardness is higher by 50 Hv or more than a hardness of a primary phase (a hardness of a portion that is not hardened by the gas soft nitriding treatment, for example, in a case where a thickness is indicated as tc, a tc/4 position), is less than 0.300 mm.

In addition, in a case where a right side of Formula (2) is 94 or less, a surface layer hardness of the steel sheet after the gas soft nitriding treatment does not become 500 Hv or more, which is a surface layer hardness generally required for a gas-soft nitrided component.

Therefore, the sol. Al content, the Cr content, and the Mn content are contained in the above-described ranges so as to satisfy Formulas (1) and (2).

$$[\text{sol. Al}]+[\text{Cr}]\leq 0.482 \quad \text{Formula (1)}$$

$$94<64\times[\text{Mn}]+156\times[\text{Cr}]+190\times[\text{sol. Al}]-9\times[\text{Mn}]^2-86\times[\text{Cr}]^2-328\times[\text{sol. Al}]^2 \quad \text{Formula (2)}$$

where [element symbol] is an amount of an element represented by the element symbol in steel by mass %. If necessary, a right side of Formula (1) may be set to 0.478, 0.472, 0.467, 0.460, or 0.440 instead of 0.482. A lower limit of "[sol. Al]+[Cr]" in Formula (1) is 0.120, but may be set to 0.150, 0.180, or 0.200. Furthermore, a left side of Formula (2) may be set to 97, 100, or 105, instead of 94.

The steel sheet for gas soft nitriding according to the present embodiment basically contains the above-mentioned elements and a remainder including Fe and impurities, as the chemical composition. Here, the impurities mean components that are mixed due to various factors in raw materials such as ore and scrap, and in the manufacturing process when the steel sheet is manufactured, and are permitted within a range that does not adversely affect the present invention. On the other hand, in order to improve various properties, Cu, Ni, Nb, V, Mo, B, Ca, REM, Sn, Sb, As, and Mg may be further contained within a range described below. However, since the inclusion of these elements is not essential, lower limits thereof are all 0%. These elements may be contained as impurities within ranges of amounts described below.

Cu: 0% to 0.40%

Cu is an element that contributes to the improvement of the surface layer hardness after the gas soft nitriding treatment. Therefore, Cu may be contained. In a case of obtaining the above effect, a Cu content is set to preferably 0.01% or more, and more preferably 0.03% or 0.07% or more.

On the other hand, when the Cu content is more than 0.40%, hot cracking is likely to occur during manufacturing. Therefore, in a case where the Cu is contained, the Cu content is set to 0.40% or less. The Cu content is preferably 0.35% or less or 0.35% or less, and more preferably 0.25% or less or 0.20% or less.

Ni: 0% to 0.30%

Ni is an element that contributes to the improvement of the surface layer hardness after the gas soft nitriding treatment. In addition, Ni is an element having an effect of suppressing hot cracking when Cu is contained. Therefore, in the case where Cu is contained, it is preferable that Ni is also contained. In a case of obtaining the above effect, a Ni content is set to preferably 0.01% or more, and more preferably 0.03% or more.

On the other hand, when the Ni content is excessive, an alloy cost increases, and economic efficiency is impaired. Therefore, in a case where Ni is contained, the Ni content is set to 0.30% or less. The Ni content is preferably 0.25% or less or 0.20% or less, and more preferably 0.15% or less or 0.10% or less.

Nb: 0% to 0.080%

Nb is an element having an effect of refining the austenite grain sizes during hot rolling and is an element having an effect of reducing the average effective grain size of the steel sheet through this effect. Therefore, Nb may be contained. In a case of obtaining the above effect, a Nb content is set to preferably 0.001% or more, and more preferably 0.005% or more or 0.010% or more.

On the other hand, when the Nb content is more than 0.080%, toughness of the slab after casting decreases, which causes cracking of the slab. Therefore, in a case where Nb is contained, the Nb content is set to 0.080% or less. The Nb content is preferably 0.070% or less or 0.0.060% or less, and more preferably 0.050% or less or 0.040% or less.

V: 0% to 0.080%

V is a nitride forming element and is an element having an effect of improving the surface layer hardness after the soft nitriding treatment. Therefore, V may be contained. In a case of obtaining the above effect, a V content is set to preferably 0.001% or more, and more preferably 0.003% or more or 0.010% or more.

On the other hand, when the V content is more than 0.080%, the toughness of the slab decreases, and slab cracking frequently occurs before the slab is loaded into a heating furnace, which results in a difficulty in manufacturing. Therefore, in a case where V is contained, the V content is set to 0.080% or less. The V content is preferably 0.070% or less or 0.050% or less, and more preferably 0.040% or less or 0.030% or less.

Mo: 0% to 0.100%

Mo is a nitride forming element and is an element having an effect of improving the surface layer hardness. Therefore, Mo may be contained. In a case of obtaining the above effect, a Mo content is set to preferably 0.001% or more, and more preferably 0.003% or more or 0.005% or more.

On the other hand, when the Mo content is more than 0.100%, hardenability increases, an area ratio of martensite increases, and a predetermined metallographic structure cannot be obtained in the steel sheet. Therefore, in a case where Mo is contained, the Mo content is set to 0.100% or less. The Mo content is preferably 0.080% or less or 0.060% or less, and more preferably 0.040% or less or 0.030% or less.

B: 0% to 0.0020%

B is a nitride forming element and is an element having an effect of improving the surface layer hardness. Therefore, B may be contained. In a case of obtaining the above effect, a B content is set to preferably 0.0001% or more, and more preferably 0.0003% or more or 0.0006% or more.

On the other hand, when the B content is more than 0.0020%, the hardenability increases, the area ratio of martensite increases, and a predetermined metallographic structure cannot be obtained in the steel sheet. Therefore, in a case where B is contained, the B content is set to 0.0020% or less. The B content is preferably 0.015% or less or 0.0010% or less, and more preferably 0.0008% or less or 0.0004% or less.

Ca: 0% to 0.0100%

Ca is an element that forms fine sulfides and is an element having an effect of improving press formability. Therefore, Ca may be contained. In a case of obtaining the above effect, a Ca content is set to preferably 0.0001% or more, and more preferably 0.0005% or more or 0.0010% or more.

On the other hand, when the Ca content is more than 0.0100%, an oxide of Ca is deposited in a casting nozzle during casting, and there is a concern that the nozzle is clogged. Therefore, in a case where Ca is contained, the Ca content is set to 0.0100% or less. The Ca content is preferably 0.0080% or less or 0.0060% or less, and more preferably 0.0040% or less or 0.0020% or less.

REM: 0% to 0.0100%

Rare earth elements (that is, REM) such as Sc, Y, La, Lu, and Ce are elements having an effect of reducing an effective grain size difference by delaying growth of y grains above a certain value during rolling. Therefore, REM may be contained. In a case of obtaining the above effect, a REM content is preferably set to 0.0001% or more, and more preferably set to 0.0005% or more or 0.0010% or more.

On the other hand, even when the REM content is more than 0.0100% in total, the effect is saturated, so that the economic efficiency is lowered due to a cost of adding REM. Therefore, in a case where REM is contained, the REM content is set to 0.0100% or less. The REM content is preferably 0.0080% or less or 0.0060% or less, and more preferably 0.0040% or less or 0.0020% or less.

Sn: 0 to 0.0300%

Sn is an element effective for improving corrosion resistance. Therefore, Sn may be contained. In a case of obtaining the above effect, a Sn content is set to preferably 0.0001% or more, and more preferably 0.0010% or more.

On the other hand, when the Sn content is more than 0.0300%, surface cracks occur during rolling, and the productivity significantly decreases. Therefore, the Sn content is set to 0.0300% or less. The Sn content is preferably 0.0250% or less or 0.0200% or less, and more preferably 0.0150% or less or 0.0100% or less.

Sb: 0% to 0.0100%

Sb is an element effective for improving the corrosion resistance. Therefore, Sb may be contained. In a case of obtaining the above effect, a Sb content is set to preferably 0.0001% or more, and more preferably 0.0010% or more.

On the other hand, when the Sb content is more than 0.0100%, surface cracks occur during rolling, and the productivity significantly decreases. Therefore, the Sb content is set to 0.0100% or less. The Sn content is preferably 0.0080% or less or 0.0060% or less, and more preferably 0.0040% or less or 0.0020% or less.

As: 0% to 0.0100%

As is an element effective for improving workability (machinability) of steel. Therefore, As may be contained. In a case of obtaining the above effect, an As content is set to preferably 0.0001% or more, and more preferably 0.0010% or more.

On the other hand, when the As content is more than 0.0100%, surface cracks occur during rolling, and the productivity significantly decreases. Therefore, the As content is set to 0.0100% or less. The As content is preferably 0.0080% or less or 0.0060% or less, and more preferably 0.0040% or less or 0.0020% or less.

Mg: 0% to 0.0300%

Mg is an element having an effect of suppressing a decrease in bendability due to a coarse nitride by forming a nitride formation site formed after solidification. Therefore, Mg may be contained. In a case of obtaining the above effect, a Mg content is set to preferably 0.0001% or more, and more preferably 0.0005% or more or 0.0010% or more.

On the other hand, when the Mg content is more than 0.0300%, sparks occur when the raw materials are charged, and the productivity is significantly impaired. Therefore, in a case where Mg is contained, the Mg content is set to 0.0300% or less. The Mg content is preferably 0.0250% or less or 0.0200% or less, and more preferably 0.0100% or less or 0.0050% or less.

The chemical composition described above may be measured by a general analysis method. For example, the chemical composition may be measured using inductively coupled plasma-atomic emission spectrometry (ICP-AES). C and S may be measured using a combustion-infrared absorption method and N may be measured using an inert gas fusion-thermal conductivity method.

(Metallographic Structure (Microstructure))

Next, the reason for limiting the metallographic structure will be described. Hereinafter, % regarding the metallographic structure means area %.

(Ferrite: 30.0% to 100.0%)

In the steel sheet for gas soft nitriding according to the present embodiment, the area ratio of ferrite in the metallographic structure is set to 30.0% or more in order to secure sufficient elongation. The area ratio of ferrite is preferably 35.0% or more or 40.0% or more, and more preferably 50.0% or more, 60.0% or more, or 70.0% or more. An upper limit of the area ratio of ferrite is 100%. The area ratio of ferrite may be 95.0% or less, 90.0%, 80.0% or less, or 75.0% or less, if necessary.

(Martensite: 0% to 5.0%)

Martensite is a microstructure that is effective for improving the strength of the steel sheet. However, when the area ratio of martensite is more than 5.0%, the bendability of the steel sheet decreases. Therefore, the area ratio of martensite in the metallographic structure is set to 5.0% or less. The area ratio of martensite may be set to 4.5% or less, 4.0% or less, 3.5% or less, or 3.0% or less, if necessary. Since martensite does not necessarily need to be included, the area ratio thereof may be set to 0%. The area ratio of martensite may be 0.5% or more, 1.0% or more, 1.5% or more, or 2.0% or more, if necessary. The martensite may be as-quenched (so-called fresh martensite), or may be, for example, martensite that has been tempered (including self-tempered) at 370° C. or lower (so-called tempered martensite).

(Bainite: 0% to 70.0%)

Bainite is a structure effective for increasing the strength without lowering the bendability, and may be contained. In a case of obtaining this effect, an area ratio of bainite is preferably 10.0% or more. The area ratio of bainite may be set to 15.0% or more, 20.0% or more, 25.0% or more, 30.0% or more, or 35.0% or more, if necessary.

On the other hand, when the area ratio of bainite is more than 70.0%, 30.0% or more of ferrite cannot be secured, and sufficient elongation cannot be obtained. Therefore, the area ratio of bainite in the metallographic structure is set to 70.0% or less. The area ratio of bainite may be set to 65.0% or less, 60.0% or less, 55.0% or less, 50.0% or less, or 45.0% or less, if necessary. Since bainite does not necessarily need to be included, the area ratio thereof may be 0%.

(Other Microstructures)

A remainder of the steel sheet for gas soft nitriding according to the present embodiment other than ferrite, martensite, and bainite is not limited, but may contain, for example, pearlite and/or retained austenite.

An area ratio of retained austenite is 3.0% or less, and preferably 2.0% or less or 1.0% or less. An area ratio of pearlite is 3.0% or less, and preferably 2.0% or less or 1.0% or less.

The area ratios of retained austenite and pearlite may be each 0%. A sum of the area ratios of retained austenite and pearlite may be set to 3.0% or less, 2.0% or less, or 1.0% or less.

(Effective Grain Size)

In the steel sheet for gas soft nitriding according to the present embodiment, when a sheet thickness of the steel sheet is indicated as t, a sheet width, which is a width in a direction perpendicular to a rolling direction, is indicated as w, and effective grain sizes are measured at seven positions of w/8, w/4, 3w/8, w/2, 5w/8, 3w/4, and 7w/8 in a width direction (on a straight line perpendicular to the rolling direction) from an end portion in the width direction (the direction perpendicular to the rolling direction) at a t/4 position from a surface in a sheet thickness direction, an average effective grain size, which is an average of the effective grain sizes at the seven positions, is 8.0 to 35.0 μm, and an effective grain size difference, which is a difference between a maximum value and a minimum value among the effective grain sizes at the seven positions, is 10.0 μm or less.

As described above, in the gas-soft nitrided component, there is a problem of a shape change due to the gas soft nitriding treatment. The present inventors investigated a gas-soft nitrided test piece of a hat-formed material, which will be described later, and conducted an examination for minimizing a shape change due to the gas soft nitriding treatment and maximizing the performance of a component.

Specifically, a ring-shaped test piece having a width of 10 mm as shown in FIG. 1 was prepared by shear trimming (punching using a trimming die) centered on a ½ position, a ¼ position, and a ⅛ position of the steel sheet in the width direction. A large residual stress usually remains at a trimmed end and the like. For the purpose of investigating the influence, inner and outer circumferences of the ring test piece were left as shear-trimmed end surface.

The ring-shaped test piece was subjected to a gas soft nitriding treatment in an atmosphere of a mixed gas containing 45% of nitrogen, 50% of ammonia, and 5% of carbon dioxide in terms of volume fraction. A treatment temperature was set to 570° C., and a soaking and holding time was set to 1 hour. After performing the treatment with the atmosphere, temperature, and time, a shape change of the ring-shaped gas-soft nitrided test piece cooled to room temperature by air cooling was measured. For the measurement of the shape change, outer diameters in the rolling direction, in a direction perpendicular thereto, and in directions at 45° and 135° with respect to the rolling direction were measured before and after the treatment. Those having an amount of change of more than 0.5% (1 mm in this test) in each direction of the measurement had poor dimensional accuracy, caused problems in use as the component, and were determined to be unacceptable.

As a result of the examination, it was found that in order to increase dimensional accuracy, it is effective to set the difference between the maximum value and the minimum value among the effective grain sizes (that is, the effective grain size difference) at the positions in the width direction of the steel sheet to 10.0 μm or less. In a case where the effective grain size difference is more than 10.0 μm, the shape change after the gas soft nitriding treatment becomes large.

Although it is unclear why the shape change after the gas soft nitriding treatment is suppressed by reducing variation in the effective grain size in the width direction, it is presumed that strain or residual stress inside the steel sheet is reduced by the uniformization of the metallographic structure in the width direction of the steel sheet, and as a result, a shape change after heating is suppressed.

In addition, regarding the variation in the effective grain size in the width direction, it was found that an effective grain size difference at a position at which the width of the steel sheet is divided into eight equal parts represents the effective grain size difference in the entire width direction.

Therefore, in the steel sheet for gas soft nitriding according to the present embodiment, the effective grain size differences at the seven positions of w/8, w/4, 3w/8, w/2, 5w/8, 3w/4, and 7w/8 in the width direction from the end portion in the width direction are set to 10.0 μm or less. The effective grain size difference is preferably 9.0 μm or less, and more preferably 8.0 μm or less or 7.0 μm or less.

The effective grain size is less likely to vary in the rolling direction than in the width direction. Therefore, the effective grain size difference in the width direction may be set within a predetermined range.

When the average effective grain size is less than 8.0 μm, the effective hardening depth is less than 0.300 mm. On the other hand, when an average grain size is more than 35.0 μm, the bendability decreases. Therefore, the average effective grain size is set to 8.0 to 35.0 μm.

Furthermore, the "effective grain size difference/average effective grain size" may be set to 0.80 or less, 0.70 or less, 0.60 or less, 0.50 or less, or 0.40 or less.

Even in a case where there is little variation in a material (hardness and the like) in the width direction, it cannot be said that the effective grain size difference becomes small. In a range investigated by the present inventors, even in a steel sheet having little material variation in the width direction, the effective grain size always greatly varied in the width direction.

The area ratios of ferrite, martensite, bainite, pearlite, and austenite in the metallographic structure, the average effective grain size, and the effective grain size difference can be obtained by the following methods.

(Area Ratio of Ferrite)

The area ratio of ferrite can be obtained by performing an EBSD analysis using an apparatus including a thermal field-emission scanning electron microscope (JSM-7001F manufactured by JEOL Ltd.) and an EBSD detector (DVC5 type detector manufactured by TSL solutions).

Specifically, when the sheet width, which is the width in the direction perpendicular to the rolling direction of the steel sheet for gas soft nitriding according to the present embodiment is indicated as w, a sample is collected from each of the positions of w/8, w/4, 3w/8, w/2, 5w/8, 3w/4, and 7w/8 in the width direction from the end portion in the width direction so that the sample has a size of 10 mm in the direction perpendicular to the rolling direction. Then, for each sample, a cross section perpendicular to the rolling direction is roughly polished with #1000, subjected to a mirror polishing finish with a polishing solution in which diamond powder having a particle size of 1 to 3 μm is dispersed, and a surface thereof is subjected to polishing strain removal by electrolytic polishing and finished as a sample for observation.

Figure 2:
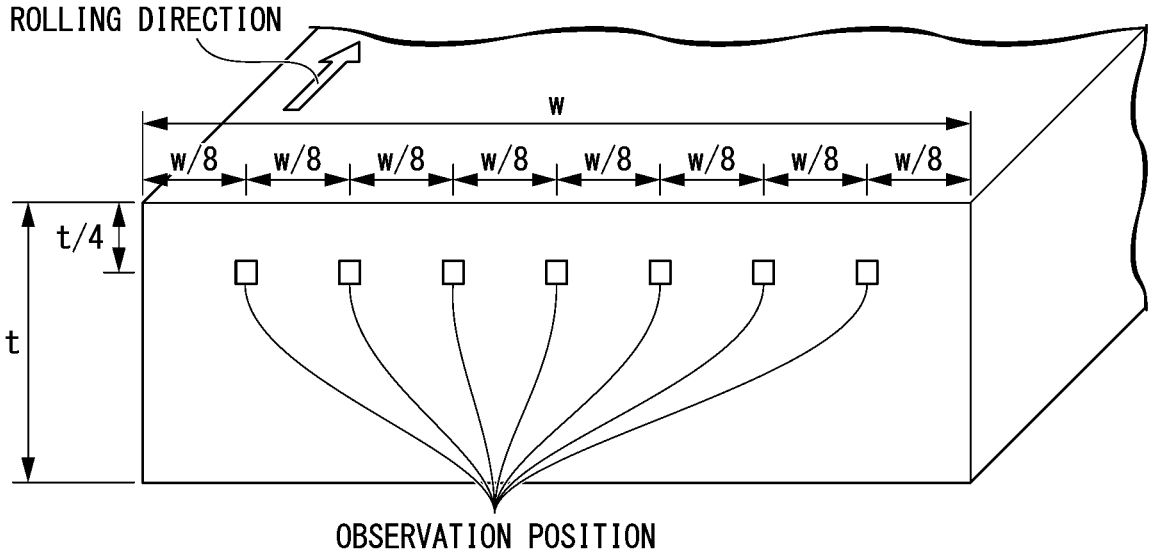
FIG. 2 is a diagram showing observation positions of a metallographic structure.

For each of the obtained samples for observation, when the sheet thickness of the steel sheet for gas soft nitriding according to the present embodiment is indicated as t, a range of 200 μm in the sheet thickness direction and 400 μm in the direction perpendicular thereto substantially centered on the t/4 position (t/4 depth position) in the sheet thickness direction from the surface of the cross section in the sheet thickness direction is taken as an observation position. That is, the observation position is a position shown in FIG. 2.

The electron backscatter diffraction (EBSD) analysis is performed on the sample to obtain crystal orientation information. In the EBSD analysis, a degree of vacuum in the apparatus is set to $1.0\times10^{-4}$ Pa or less, an accelerating current is set to 15 kV, an irradiation current level is set to 13 or more and 15 or less, an irradiation level of an electron beam is set to 62, WD is set to 15 mm, and a measurement interval is set to 0.05 μm or more and 0.5 μm or less.

Using the crystal orientation information obtained in this EBSD analysis, ferrite is identified and the area ratio thereof is calculated by the software "OIM Analysis (registered trademark)" attached to the EBSD analyzer. In the present embodiment, from a figure determined to be a bcc phase on an inverse pole figure color map output by the "OIM Analysis (registered trademark)", a boundary at which an orientation difference between adjacent measurement points is 15° or more is defined as a grain boundary, and a GAM value of each grain is calculated. Those having a GAM value of 0.5 or less are defined as ferrite grains, and an area ratio of the ferrite grains is calculated. The area ratio of the ferrite grains is measured for the samples for observation at each position in the width direction, and an average value thereof is defined as the area ratio of ferrite.

(Area Ratio of Martensite)

The area ratio of martensite is obtained by determining a microstructure observed as a white contrast as martensite using a metallographic structure photograph taken by revealing the metallographic structure using a LePera etching solution, and measuring an area ratio thereof. Collecting positions and observation positions of samples for observation are the same as in the case of ferrite, and the average value of the area ratios of martensite obtained in the samples is defined as the area ratio of martensite in the steel sheet for gas soft nitriding according to the present embodiment.

(Area Ratio of Pearlite)

The area ratio of the pearlite is obtained by using a metallographic structure photograph taken by revealing the metallographic structure using a nital etching solution. Specifically, in the metallographic structure photograph, grains containing lamellar carbides are defined as pearlite, and are obtained by an area ratio thereof. Sampling position and observation positions of samples for observation are the same as in the case of ferrite, an area ratio of pearlite is obtained from each sample, and an average value of the area ratios of pearlite of all the samples is defined as the area ratio of pearlite of the steel sheet for gas soft nitriding according to the present embodiment.

(Area Ratio of Retained Austenite)

Using the crystal orientation information obtained when measuring the area ratio of ferrite, an area ratio of a point determined to be an fcc phase is defined as the area ratio of retained austenite. Sampling positions and observation positions of samples for observation are the same as in the case of ferrite, an area ratio of retained austenite is obtained from each sample, and an average value of the area ratios of retained austenite of all the samples is defined as the area ratio of retained austenite of the steel sheet for gas soft nitriding according to the present embodiment.

(Area Ratio of Bainite)

In the steel sheet for gas soft nitriding according to the present embodiment, portions other than ferrite, pearlite, retained austenite, and martensite are determined to be bainite. That is, the area ratio of bainite is obtained by subtracting the area ratios of the above-mentioned ferrite, pearlite, retained austenite, and martensite from 100%.

(Average Effective Grain Size)

(Effective Grain Size Difference)

Using the crystal orientation information obtained when measuring the area ratio of ferrite, from a figure determined to be a bcc phase on an inverse pole figure color map output by the "OIM Analysis (registered trademark)", a boundary at which an orientation difference between adjacent measurement points is 15° or more is defined as a grain boundary, and a circle equivalent diameter of the grain is defined as a grain size of the grain. An average value is obtained using the grain sizes of all the grains in an observed visual field, and an effective grain size in the observed visual field is obtained. Sampling positions and observation positions of samples for observation are the same as in the case of measuring the area ratio of ferrite, an effective grain size is obtained from each sample, and an average value of the effective grain sizes of all the samples is defined as the average effective grain size in the direction (sheet width direction) perpendicular to the rolling direction of the steel sheet for gas soft nitriding according to the present embodiment.

In addition, a difference between the largest value and the smallest value among the effective grain sizes at the observation positions is defined as the effective grain size difference in the direction perpendicular to the rolling direction of the steel sheet for gas soft nitriding according to the present embodiment.

(Mechanical Properties)

The steel sheet for gas soft nitriding according to the present embodiment may have a tensile strength of 370 MPa or more measured according to JIS Z2241:2011 using a No. 5 test piece of JIS Z2241:2011 and an elongation of 13.0% or more as generally required mechanical properties. The tensile strength may be set to 400 MPa or more, 440 MPa or more, 480 MPa or more, 520 MPa or more, 580 MPa or more, or 620 MPa or more. Although it is not necessary to set an upper limit of the tensile strength, the tensile strength may be set to 880 MPa or less, 800 MPa or less, 760 MPa, 720 MPa or less, or 680 MPa or less. The elongation may be set to 14.0% or more, 16.0% or more, 18.0% or more, or 20.0% or more. Although it is not necessary to set an upper limit of the elongation, the elongation may be set to 32.0% or less, 28.0% or less, or 26.0% or less.

Furthermore, R/t, which is a limit bend radius R standardized by the sheet thickness t, may be 3.0 or less. In this case, when cold working (pressing or the like) is performed before the gas soft nitriding treatment, cracking or the like during the cold working can be prevented.

In addition, when it is assumed that the steel sheet for gas soft nitriding according to the present embodiment is applied to a component that transmits power around an engine after the gas soft nitriding treatment, an object of the steel sheet for gas soft nitriding according to the present embodiment is to have a surface layer hardness of 500 Hv or more by the gas soft nitriding treatment and an effective hardening depth of 0.300 mm or more, which is a depth with a hardness higher by 50 Hv or more than that of a primary phase (a gas-soft nitrided component having a surface layer hardness of 500 Hv or more and an effective hardening depth of 0.300 mm or more, which is a depth with a hardness higher by 50 Hv or more than that of the primary phase can be obtained).

The surface layer hardness after the gas soft nitriding treatment is obtained by the following method.

The surface layer hardness after the gas soft nitriding treatment is a value obtained by measuring a Vickers hardness in a certain cross section of the steel sheet after the gas soft nitriding treatment in the sheet thickness direction. A measurement position may be set such that an indentation center is located in a range of 50 μm or less from the surface where a change in hardness in the sheet thickness direction is small. In a case where the indentation center is close to a surface layer, a material flow in the vicinity of the surface layer occurs during hardness measurement, which causes a measurement error. Therefore, it is preferable that the indentation center is at a position 35 μm or more away from the surface in the cross section of the steel sheet in the sheet thickness direction. The Vickers hardness may be measured based on JIS Z 2244-1:2020. A load during the hardness measurement is set to 200 gf (Hv0.2), and an average value measured at three points at depth positions in the sheet thickness direction is defined as the surface layer hardness after the gas soft nitriding treatment.

As a measurement cross section for the Vickers hardness, a certain cross section of the gas-soft nitrided component in the sheet thickness direction is roughly polished to #80 to #1000 and is finished to a mirror-polished surface with a polishing solution in which diamond powder having a particle size of 1 to 3 μm is dispersed.

The effective hardening depth after the gas soft nitriding treatment is measured by measuring the Vickers hardness of the steel sheet after the gas soft nitriding treatment at intervals of 0.05 μm from the surface layer in a depth direction in a certain cross section in the sheet thickness direction. Three points are measured at the same depth, and an average value thereof is defined as the Vickers hardness at that depth. In the obtained Vickers hardness profile, when the sheet thickness is indicated as t, a depth of a region in which a hardness is higher by 50 Hv or more than the average (average hardness) of the Vickers hardnesses measured at three points at the t/4 position from the surface in the sheet thickness direction is measured, and this is defined as the effective hardening depth. A measurement load of the Vickers hardness is set to 50 gf (Hv0.05), and a load may be set or a measurement position may be shifted in a sheet surface direction so that an interval between the measurement points is 5 times or more an indentation size.

The above is microstructure requirements for satisfying basic properties of the steel sheet for gas soft nitriding and a measurement method thereof.

The sheet thickness and the width of the steel sheet for gas soft nitriding according to the present embodiment are not particularly limited, and in a case where application to an assumed component is taken into consideration, it is preferable that the sheet thickness is 1.2 to 3.6 mm, and the width is 900 to 1500 mm. The steel sheet for gas soft nitriding according to the present embodiment may be a steel sheet with a so-called mill edge (including a steel strip and also referred to as a mill edge steel sheet), or a steel sheet from which a mill edge portion is removed by cutting (including a steel strip and also referred to as a cut edge steel sheet).

<Gas-Soft Nitrided Component>

A gas-soft nitrided component according to the present embodiment will be described. The gas-soft nitrided component according to the present embodiment can be obtained by processing the above-described steel sheet for gas soft nitriding according to the present embodiment as necessary and then performing the gas soft nitriding treatment.

(Chemical Composition)

A chemical composition of the gas-soft nitrided component according to the present embodiment is the same as that of the steel sheet for gas soft nitriding according to the present embodiment, which is a material, excluding a nitrided region of a surface layer area (for example, in a case where the thickness of the component is indicated as tc, at a tc/4 position from the surface in the thickness direction). Therefore, description thereof will be omitted.

(Nitrided Region)

The gas-soft nitrided component according to the present embodiment has a nitrided region in which a nitride is present on the surface. In the gas-soft nitrided component according to the present embodiment, a surface layer hardness is set to 500 Hv or more, and a thickness (effective hardening depth) of a region in which a hardness is higher by 50 Hv or more than a hardness of a primary phase (an average hardness at a tc/4 position from the surface in the thickness direction), is set to 0.300 mm or more. When the surface layer hardness is less than 500 Hv or the thickness of the region in which the hardness is higher by 50 Hv or more than the hardness of the primary phase is less than 0.300 mm, a predetermined wear resistance cannot be obtained.

The surface layer hardness is obtained by the following method as described above.

The surface layer hardness of the gas-soft nitrided component is a value obtained by measuring a Vickers hardness in a certain cross section of the gas-soft nitrided component in the thickness direction. A measurement position may be set such that an indentation center is located in a range of 50 μm or less from the surface where a change in hardness in the thickness direction is small. In a case where the indentation center is close to a surface layer, a material flow in the vicinity of the surface layer occurs during hardness measurement, which causes a measurement error. Therefore, it is preferable that the indentation center is at a position 35 μm or more away from the surface in the cross section of the steel sheet in the sheet thickness direction. The Vickers hardness may be measured based on JIS Z 2244-1:2020. The load at the time of measuring the hardness is 200 gf (Hv0.2), and the average value measured at three points at the above-described depth positions in the thickness direction is regarded as the surface layer hardness of the gas-soft nitrided component. As a measurement cross section for the Vickers hardness, a certain cross section of the gas-soft nitrided component in the thickness direction is roughly polished to #80 to #1000 and is finished to a mirror-polished surface with a polishing solution in which diamond powder having a particle size of 1 to 3 μm is dispersed.

The thickness of the region in which the hardness is higher by 50 Hv or more than the hardness of the primary phase can be obtained by the following method.

(Thickness of Region in which Hardness is Higher by 50 Hv or More than Hardness of Primary Phase)

The Vickers hardness measured at intervals of 0.05 μm from the surface layer in the depth direction in a certain cross section in the thickness direction of the gas-soft nitrided component is measured. Here, three points are measured at the same depth, and an average value thereof is defined as the Vickers hardness at that depth. In the obtained Vickers hardness profile, when the thickness is indicated as tc, a depth of a region in which a hardness is higher by 50 Hv or more than the average (average hardness) of the Vickers hardnesses measured at three points at the tc/4 position from the surface in the thickness direction is measured, and this is defined as the thickness of the region in which the hardness is higher by 50 Hv or more than the hardness of the primary phase. A measurement load of the Vickers hardness is set to 50 gf (Hv0.05), and a load may be set or a measurement position may be shifted in a sheet surface direction so that an interval between the measurement points is 5 times or more an indentation size.

(Metallographic Structure)

A metallographic structure of the gas-soft nitrided component according to the present embodiment is not limited, and may be the same as that of the steel sheet for gas soft nitriding according to the present embodiment, which is a material, excluding the nitrided region of the surface layer area (for example, at the tc/4 position from the surface in the thickness direction).

<Manufacturing Method>

Next, a manufacturing method of the steel sheet for gas soft nitriding according to the present embodiment will be described.

The steel sheet for gas soft nitriding according to the present embodiment is obtained by a manufacturing method including the following steps. If necessary, after the following steps (I) to (IV), a (V) pickling step or (VI) a skin pass step described below may be applied.

(I) A heating step of heating a slab having a predetermined chemical composition.

(II) A hot rolling step of performing rough rolling and finish rolling on the slab after the heating step to obtain a hot-rolled steel sheet.

(III) A cooling step of cooling the hot-rolled steel sheet after the hot rolling step.

(IV) A coiling step of coiling the hot-rolled steel sheet after the cooling step.

Preferred conditions will be described for each step. As conditions for which the description is omitted, known conditions can be applied.

(Heating Step)

In the heating step, a slab (for example, a slab having a thickness of about 50 to 300 mm) having the same chemical composition as that of the above-described steel sheet for gas soft nitriding according to the present embodiment manufactured by continuous casting is heated under the following conditions. By managing a furnace temperature, variation in microstructures (grain sizes) in a sheet width direction is reduced. It is presumed that the reason for this is that variation in austenite grain sizes in the slab is reduced by managing the furnace temperature.

(a) A primary heating is performed by allowing the slab to stay in a primary heating furnace adjusted to an atmospheric temperature of 400° C. to 1260° C. for 10 to 100 minutes.

(b) A secondary heating is performed by allowing the slab after the primary heating to stay in a secondary heating furnace having an atmospheric temperature higher than that of the primary heating and adjusted to 950° C. to 1325° C. for 20 to 170 minutes.

(c) A tertiary heating is performed by allowing the slab after the secondary heating to stay in a tertiary heating furnace having an atmospheric temperature adjusted to 1130° C. to 1310° C. for 20 to 150 minutes.

When any of the conditions of the primary heating to the tertiary heating is outside of the range, the effective grain size difference in the sheet width direction is more than 10.0 μm. The atmospheric temperature when the slab is heated indicates a furnace temperature controlled by a thermometer installed in the furnace. Even in a case where the slab is not cooled to room temperature, it is necessary to use this heating method, and a temperature of the slab loaded into the primary heating furnace is preferably 800° C. or lower and more preferably 100° C. or lower.

(Hot Rolling Step)

In the hot rolling step, the heated slab is subjected to rough rolling and finish rolling to obtain a hot-rolled steel sheet.

In the rough rolling, a cumulative rolling reduction is set to 60% or more and 90% or less.

The cumulative rolling reduction is a sheet thickness reduction ratio calculated using a slab thickness t0 and a thickness t1 after the rough rolling. In a case where the cumulative rolling reduction in the rough rolling is less than 60%, the average effective grain size in the sheet width direction is not 35.0 μm or less. In addition, when the cumulative rolling reduction is more than 90%, the average effective grain size is less than 8.0 km.

A rough rolling temperature may be set in a range of 1000° C. to 1200° C., and the number of times of rolling may be set from a load on a rolling mill. The number of times of rough rolling is preferably, for example, five.

In the finish rolling, a rolling start temperature is set to 980° C. or higher, a rolling reduction in a final pass is set to 4% to 30%, and a finish temperature is set to 840° C. to 960° C.

In a case where a finish rolling start temperature is lower than 980° C., the effective grain size difference in the width direction of the steel sheet is more than 10.0 μm.

In addition, in a case where the rolling reduction in the final pass is less than 4%, rolling strain becomes non-uniform, and the effective grain size difference in the width direction of the steel sheet is more than 10 μm. On the other hand, when the rolling reduction in the final pass is more than 30%, the average effective grain size in the width direction is more than 35.0 μm due to grain growth.

In addition, in a case where the finish temperature is lower than 840° C., the average effective grain size in the width direction is less than 8.0 μm. On the other hand, when the finish temperature is higher than 960° C., the average effective grain size in the width direction is more than 35.0 μm.

In addition, as long as the rolling reduction in the final pass falls within the above range, the number of times of rolling is not particularly limited, and the number of times may be set from the load on the rolling mill. The number of times of finish rolling is preferably, for example, five.

In the hot rolling step, the subsequent cooling step, and the coiling step, the temperature is preferably managed by a surface temperature at a center in the width direction.

(Cooling Step)

(Coiling Step)

After the finish rolling is completed (after the reduction in the final pass), water cooling is started within 2.0 seconds, the water cooling is completed within 20.0 seconds after the start of the cooling, and the steel sheet is coiled at 430° C. to 580° C.

In a case where the time from the reduction in the final pass to the start of the cooling is longer than 2.0 seconds, the area ratio of ferrite is less than 30.0%. A cooling start time is not limited as long as the cooling start time is within 2.0 seconds after the completion of the finish rolling, but may be 0.4 seconds or longer, or 0.6 seconds or longer in consideration of an air-cooling zone distance in the temperature measurement after the rolling.

In addition, when a water cooling time from the start of the cooling to a range of 430° C. to 580° C., which is a coiling temperature, is longer than 20.0 seconds, the area ratio of ferrite is less than 30.0% and the area ratio of bainite is more than 70.0%. When the coiling temperature is lower than 430° C., the area ratio of martensite is more than 5.0%. On the other hand, in a case where the coiling temperature is higher than 580° C., the effective grain size difference in the width direction of the steel sheet is more than 10.0 km.

(Pickling Step)

(Skin Pass Rolling Step)

Pickling may be performed after the coiling step. The pickling is intended to remove scale on the surface of the steel sheet, and may be performed by a known method. In addition, skin pass rolling may be performed on the pickled steel sheet. By introducing moving dislocations by the skin pass rolling, not only can a yielding elongation be suppressed but also a dislocation density on the surface of the steel sheet can be increased. In the case of performing the skin pass, conditions that do not significantly reduce the elongation may be set. For example, a rolling reduction in the skin pass rolling is preferably set to 0.5% to 5.0%. When the rolling reduction is less than 0.5%, there is a concern that the yielding elongation cannot be suppressed, and when the rolling reduction is more than 5.0%, there is concern that dislocations are introduced to the center in the sheet thickness direction and ductility decreases.

EXAMPLES

Cast pieces having the chemical composition shown in Table 1 (unit: mass %, remainder: Fe and impurities) were used, and each thereof was heated, rolled, cooled, and coiled under the conditions shown in Table 2 to manufacture a coil having a sheet thickness 1.2 to 2.3 mm and a sheet width of 1000 to 1500 mm.

In Table 1, the field of Formula 1 represents a calculated value on the left side of Formula (1), and the field of Expression 2 represents a calculated value on the right side of Formula (2).

TABLE 1

| Steel | C | Si | Mn | P | S | sol. Al | Ti | Cr | N | Cu | Ni | V | Mo |
|---|---|---|---|---|---|---|---|---|---|---|---|---|---|
| 1 | 0.04 | 0.013 | 0.70 | 0.005 | 0.003 | 0.230 | 0.041 | 0.183 | 0.0032 | tr. | tr. | tr. | tr. |
| 2 | 0.05 | 0.024 | 1.47 | 0.008 | 0.004 | 0.360 | 0.036 | 0.093 | 0.0028 | tr. | tr. | tr. | tr. |
| 3 | 0.04 | 0.016 | 0.57 | 0.008 | 0.002 | 0.208 | 0.038 | 0.270 | 0.0030 | tr. | tr. | tr. | tr. |
| 4 | 0.06 | 0.012 | 0.86 | 0.009 | 0.003 | 0.233 | 0.063 | 0.165 | 0.0031 | tr. | tr. | tr. | tr. |
| 5 | 0.07 | 0.035 | 0.94 | 0.010 | 0.002 | 0.320 | 0.055 | 0.159 | 0.0028 | tr. | tr. | tr. | tr. |
| 6 | 0.08 | 0.094 | 0.95 | 0.011 | 0.003 | 0.121 | 0.083 | 0.217 | 0.0033 | tr. | tr. | tr. | tr. |
| 7 | 0.10 | 0.018 | 1.23 | 0.009 | 0.003 | 0.024 | 0.082 | 0.456 | 0.0030 | tr. | tr. | tr. | tr. |
| 8 | 0.09 | 0.022 | 1.27 | 0.008 | 0.003 | 0.008 | 0.078 | 0.232 | 0.0029 | tr. | tr. | tr. | tr. |
| 9 | 0.12 | 0.038 | 1.12 | 0.019 | 0.004 | 0.040 | 0.083 | 0.321 | 0.0031 | tr. | tr. | tr. | tr. |
| 10 | 0.03 | 0.008 | 1.64 | 0.006 | 0.001 | 0.380 | 0.105 | 0.138 | 0.0026 | tr. | tr. | tr. | tr. |
| 11 | 0.07 | 0.003 | 1.68 | 0.014 | 0.003 | 0.311 | 0.101 | 0.138 | 0.0029 | tr. | tr. | tr. | tr. |
| 15 | 0.01 | 0.015 | 1.58 | 0.013 | 0.003 | 0.324 | 0.097 | 0.136 | 0.0030 | tr. | tr. | tr. | tr. |
| 13 | 0.04 | 0.011 | 0.98 | 0.013 | 0.002 | 0.216 | 0.054 | 0.152 | 0.0031 | tr. | tr. | tr. | tr. |
| 14 | 0.06 | 0.032 | 0.96 | 0.015 | 0.003 | 0.232 | 0.055 | 0.156 | 0.0032 | tr. | tr. | tr. | tr. |
| 15 | 0.06 | 0.027 | 0.95 | 0.011 | 0.004 | 0.162 | 0.126 | 0.260 | 0.0018 | tr. | tr. | tr. | tr. |
| 16 | 0.05 | 0.082 | 1.05 | 0.012 | 0.002 | 0.156 | 0.118 | 0.244 | 0.0054 | 0.09 | 0.04 | tr. | tr. |
| 17 | 0.07 | 0.074 | 1.08 | 0.008 | 0.002 | 0.168 | 0.116 | 0.253 | 0.0032 | tr. | tr. | 0.046 | tr. |
| 18 | 0.04 | 0.042 | 1.11 | 0.010 | 0.003 | 0.160 | 0.109 | 0.254 | 0.0031 | tr. | tr. | tr. | 0.032 |
| 19 | 0.05 | 0.051 | 1.63 | 0.009 | 0.002 | 0.152 | 0.111 | 0.262 | 0.0029 | tr. | tr. | tr. | tr. |
| 20 | 0.05 | 0.048 | 1.39 | 0.008 | 0.002 | 0.139 | 0.099 | 0.173 | 0.0039 | tr. | tr. | tr. | tr. |
| 21 | 0.05 | 0.051 | 1.01 | 0.011 | 0.004 | 0.183 | 0.087 | 0.259 | 0.0055 | tr. | tr. | tr. | tr. |
| 22 | 0.05 | 0.063 | 1.18 | 0.007 | 0.003 | 0.222 | 0.076 | 0.129 | 0.0037 | tr. | tr. | tr. | tr. |
| 23 | 0.05 | 0.041 | 1.21 | 0.009 | 0.001 | 0.235 | 0.099 | 0.109 | 0.0022 | tr. | tr. | tr. | tr. |
| 24 | 0.06 | 0.050 | 0.89 | 0.008 | 0.002 | 0.309 | 0.102 | 0.134 | 0.0062 | tr. | tr. | tr. | tr. |

| Steel | B | Nb | Ca | REM | Sn | Sb | As | Mg | Formula 1 | Formula 1 |
|---|---|---|---|---|---|---|---|---|---|---|
| 1 | tr. | tr. | tr. | tr. | tr. | tr. | tr. | tr. | 0.413 | 92 |
| 2 | tr. | tr. | tr. | tr. | tr. | tr. | tr. | tr. | 0.453 | 114 |
| 3 | tr. | tr. | tr. | tr. | tr. | tr. | tr. | tr. | 0.478 | 95 |
| 4 | tr. | tr. | tr. | tr. | tr. | tr. | tr. | tr. | 0.398 | 98 |
| 5 | tr. | tr. | tr. | tr. | tr. | tr. | tr. | tr. | 0.479 | 102 |
| 6 | tr. | tr. | tr. | tr. | tr. | tr. | tr. | tr. | 0.338 | 101 |
| 7 | tr. | tr. | tr. | tr. | tr. | tr. | tr. | tr. | 0.480 | 123 |
| 8 | tr. | tr. | tr. | tr. | tr. | tr. | tr. | tr. | 0.240 | 100 |
| 9 | tr. | tr. | tr. | tr. | tr. | tr. | tr. | tr. | 0.361 | 109 |
| 10 | tr. | tr. | tr. | tr. | tr. | tr. | tr. | tr. | 0.518 | 125 |
| 11 | tr. | tr. | tr. | tr. | tr. | tr. | tr. | tr. | 0.449 | 129 |
| 15 | tr. | tr. | tr. | tr. | tr. | tr. | tr. | tr. | 0.460 | 125 |

TABLE 1-continued

| | | | | | | | | | | |
|---|---|---|---|---|---|---|---|---|---|---|
| 13 | tr. | tr. | tr. | tr. | tr. | tr. | tr. | tr. | 0.368 | 101 |
| 14 | tr. | tr. | tr. | tr. | tr. | tr. | tr. | tr. | 0.388 | 102 |
| 15 | tr. | tr. | tr. | tr. | tr. | tr. | tr. | tr. | 0.422 | 109 |
| 16 | tr. | tr. | tr. | tr. | tr. | tr. | tr. | tr. | 0.400 | 112 |
| 17 | tr. | tr. | tr. | tr. | tr. | tr. | tr. | tr. | 0.421 | 115 |
| 18 | tr. | tr. | tr. | tr. | tr. | tr. | tr. | tr. | 0.414 | 116 |
| 19 | 0.0006 | tr. | tr. | tr. | tr. | tr. | tr. | tr. | 0.414 | 137 |
| 20 | tr | 0.035 | tr. | tr. | tr. | tr. | tr. | tr. | 0.312 | 116 |
| 21 | tr. | tr | 0.0060 | tr. | tr. | tr. | tr. | tr. | 0.442 | 114 |
| 22 | tr. | tr. | tr. | 0.0040 | tr. | 0.0030 | tr. | tr. | 0.351 | 108 |
| 23 | tr. | tr. | tr. | tr. | 0.0230 | tr. | tr. | tr. | 0.344 | 107 |
| 24 | tr. | tr. | tr. | tr. | tr. | tr. | 0.0050 | 0.0070 | 0.443 | 97 |

TABLE 2

| | | Primary heating | | Secondary heating | | Tertiary heating | | Rough rolling | Finish rolling | | | Cooling to Coiling | | |
|---|---|---|---|---|---|---|---|---|---|---|---|---|---|---|
| Test No. | Steel | Furnace temperature ° C. | Zone staying time min | Furnace temperature | Zone staying time min | Furnace temperature ° C. | Zone staying time min | Cumulative rolling reduction % | Rolling start temperature ° C. | Finish temperature ° C. | Rolling reduction in final pass % | Time until start of cooling sec | Time until completion of cooling sec | Coiling temperature ° C. |
| S1 | 1 | 981 | 58 | 1245 | 54 | 1253 | 68 | 85 | 1037 | 898 | 13 | 1.4 | 16.7 | 496 |
| S2 | 2 | 1162 | 36 | 1276 | 82 | 1252 | 40 | 74 | 1057 | 903 | 16 | 1.2 | 16.8 | 557 |
| S3 | 3 | 1167 | 56 | 1281 | 62 | 1226 | 52 | 87 | 1056 | 907 | 8 | 1.2 | 15.6 | 497 |
| S4 | 4 | 1122 | 24 | 1297 | 82 | 1212 | 64 | 78 | 1054 | 907 | 21 | 1.1 | 15.6 | 501 |
| S5 | 5 | 1113 | 30 | 1279 | 44 | 1233 | 74 | 86 | 1052 | 928 | 7 | 1.0 | 16.7 | 510 |
| S6 | 6 | 1069 | 30 | 990 | 52 | 1216 | 64 | 79 | 991 | 923 | 10 | 0.9 | 16.7 | 514 |
| S7 | 7 | 1158 | 60 | 1238 | 42 | 1216 | 48 | 75 | 1064 | 915 | 23 | 1.0 | 16.2 | 499 |
| S8 | 8 | 1164 | 74 | 1044 | 42 | 1233 | 50 | 73 | 1070 | 904 | 21 | 1.2 | 17.7 | 527 |
| S9 | 9 | 1170 | 46 | 988 | 40 | 1216 | 46 | 61 | 998 | 867 | 18 | 1.1 | 17.7 | 475 |
| S10 | 10 | 1203 | 52 | 1057 | 52 | 1225 | 62 | 83 | 1055 | 910 | 17 | 1.9 | 16.2 | 497 |
| S11 | 11 | 1169 | 94 | 1187 | 52 | 1219 | 58 | 79 | 1025 | 896 | 18 | 1.3 | 15.6 | 494 |
| S12 | 12 | 1043 | 64 | 1076 | 48 | 1252 | 108 | 77 | 1034 | 896 | 15 | 1.2 | 17.1 | 497 |
| S13 | 13 | 1122 | 64 | 1130 | 145 | 1267 | 110 | 63 | 1054 | 882 | 6 | 1.7 | 17.1 | 563 |
| S14 | 14 | 1154 | 74 | 1185 | 36 | 1258 | 90 | 81 | 1048 | 897 | 8 | 1.7 | 16.7 | 497 |
| S15 | 15 | 1042 | 42 | 1264 | 58 | 1244 | 84 | 84 | 1021 | 901 | 5 | 1.4 | 19.4 | 445 |
| S16 | 16 | 1135 | 32 | 1263 | 86 | 1244 | 78 | 88 | 1009 | 886 | 11 | 0.7 | 17.1 | 498 |
| S17 | 17 | 1061 | 62 | 1273 | 88 | 1237 | 86 | 82 | 1020 | 927 | 12 | 0.9 | 16.8 | 494 |
| S18 | 18 | 1044 | 92 | 1278 | 66 | 1248 | 82 | 85 | 1070 | 954 | 7 | 1.1 | 15.0 | 495 |
| S19 | 19 | 1100 | 58 | 1269 | 86 | 1257 | 108 | 79 | 1015 | 920 | 28 | 1.0 | 17.1 | 488 |
| S20 | 5 | 358 | 20 | 996 | 50 | 1232 | 106 | 76 | 1009 | 881 | 15 | 0.6 | 17.1 | 490 |
| S21 | 6 | 858 | 106 | 1260 | 50 | 1251 | 116 | 82 | 1005 | 903 | 8 | 1.1 | 17.1 | 498 |
| S22 | 4 | 1103 | 28 | 1330 | 52 | 1266 | 112 | 81 | 1037 | 908 | 13 | 1.1 | 17.1 | 491 |
| S23 | 4 | 1062 | 22 | 1245 | 11 | 1274 | 112 | 74 | 1023 | 916 | 11 | 1.3 | 16.2 | 500 |
| S24 | 5 | 968 | 20 | 1255 | 38 | 1323 | 118 | 80 | 1027 | 908 | 10 | 0.7 | 16.8 | 505 |
| S25 | 4 | 909 | 14 | 1129 | 36 | 1269 | 155 | 62 | 1007 | 917 | 12 | 0.7 | 16.2 | 493 |
| S26 | 5 | 1067 | 22 | 1203 | 130 | 1270 | 116 | 58 | 1020 | 912 | 8 | 1.9 | 15.0 | 563 |
| S27 | 6 | 780 | 22 | 1091 | 52 | 1213 | 116 | 93 | 1004 | 906 | 16 | 1.9 | 15.0 | 543 |
| S28 | 16 | 981 | 18 | 988 | 38 | 1202 | 122 | 78 | 976 | 916 | 5 | 0.9 | 16.2 | 492 |
| S29 | 5 | 1077 | 40 | 1105 | 38 | 1210 | 122 | 78 | 992 | 838 | 7 | 1.3 | 15.0 | 512 |
| S30 | 5 | 1182 | 44 | 1226 | 40 | 1289 | 72 | 62 | 1069 | 962 | 21 | 1.2 | 15.0 | 488 |
| S31 | 18 | 1087 | 42 | 1105 | 42 | 1227 | 76 | 72 | 1025 | 883 | 3 | 1.2 | 15.1 | 532 |
| S32 | 6 | 1053 | 46 | 1248 | 48 | 1244 | 124 | 86 | 1019 | 901 | 33 | 1.2 | 15.0 | 492 |
| S33 | 19 | 954 | 76 | 997 | 44 | 1209 | 42 | 68 | 1011 | 894 | 23 | 2.1 | 13.4 | 493 |
| S34 | 19 | 1182 | 36 | 1255 | 48 | 1212 | 32 | 76 | 1023 | 903 | 10 | 1.1 | 21.0 | 470 |
| S35 | 19 | 798 | 30 | 1040 | 48 | 1224 | 40 | 70 | 993 | 908 | 21 | 1.0 | 15.0 | 421 |
| S36 | 5 | 1197 | 32 | 1026 | 36 | 1212 | 46 | 83 | 1020 | 901 | 6 | 0.8 | 15.0 | 593 |
| S37 | 6 | 1272 | 28 | 1283 | 42 | 1210 | 44 | 78 | 1006 | 901 | 16 | 0.9 | 15.0 | 567 |
| S38 | 6 | 1167 | 8 | 1254 | 42 | 1213 | 34 | 66 | 991 | 899 | 5 | 1.1 | 12.9 | 493 |
| S39 | 13 | 880 | 36 | 942 | 144 | 1140 | 42 | 62 | 1015 | 898 | 26 | 1.6 | 16.7 | 491 |
| S40 | 18 | 1101 | 32 | 1130 | 178 | 1193 | 50 | 74 | 992 | 895 | 23 | 1.4 | 17.1 | 497 |
| S41 | 6 | 890 | 22 | 1118 | 80 | 1126 | 52 | 86 | 1025 | 858 | 13 | 1.6 | 16.8 | 513 |
| S42 | 5 | 1218 | 32 | 1241 | 84 | 1221 | 18 | 88 | 1031 | 853 | 11 | 1.3 | 17.1 | 567 |
| S43 | 20 | 1078 | 12 | 1120 | 46 | 1254 | 74 | 76 | 1065 | 907 | 9 | 0.7 | 14.9 | 456 |
| S44 | 21 | 1056 | 45 | 1209 | 21 | 1309 | 82 | 77 | 1047 | 883 | 11 | 0.6 | 15.2 | 498 |
| S45 | 22 | 1102 | 39 | 1189 | 76 | 1244 | 49 | 75 | 1039 | 840 | 11 | 0.8 | 15.0 | 510 |
| S46 | 23 | 1098 | 20 | 1230 | 159 | 1276 | 65 | 79 | 1055 | 858 | 10 | 0.7 | 16.4 | 487 |
| S47 | 24 | 1006 | 30 | 1178 | 79 | 1269 | 89 | 77 | 1029 | 880 | 15 | 0.9 | 16.2 | 471 |

A JIS No. 5 test piece was collected from a position of w/2 in a width direction from an end portion in the width direction at a position 10 μm away from a forefront portion in a longitudinal direction of the obtained steel sheet coil, a tensile test was conducted at a tensile speed of 10 mm/min according to JIS Z 2241:2011, and a tensile strength (TS) and an elongation (El) were measured.

In addition, a bending test was conducted using a No. 3 test piece by the method specified in the 6.1 press bending method of JIS Z 2248:2006, and R/t, which is a limit bend radius R standardized by the sheet thickness t, was measured. Here, the bend radius was tested every 0.5 times the sheet thickness to obtain a minimum R/t.

In addition, properties (area ratio, average effective grain size, effective grain size difference) of the metallographic structure at seven positions of w/8, w/4, 3w/8, w/2, 5w/8, 3w/4, and 7w/8 in the width direction from the end portion in the width direction at a t/4 depth position from a surface were measured by the above-described methods.

The results are shown in Table 3.

TABLE 3

| | Steel sheet for gas soft nitriding | | | | | | | | |
|---|---|---|---|---|---|---|---|---|---|
| Test No. | Area ratio of ferrite % | Area ratio of bainite % | Area ratio of martensite % | Other microstructures % | Average effective grain size μm | Effective grain size difference μm | TS MPa | El % | R/t — |
| S1 | 88.9 | 9.8 | 1.3 | 0.0 | 21.4 | 6.3 | 409 | 29.3 | 2.0 |
| S2 | 56.3 | 40.3 | 3.4 | 0.0 | 18.1 | 5.7 | 543 | 23.6 | 2.5 |
| S3 | 94.7 | 5.0 | 0.3 | 0.0 | 19.3 | 4.9 | 361 | 34.2 | 1.0 |
| S4 | 73.2 | 24.5 | 2.3 | 0.0 | 28.2 | 5.3 | 529 | 25.7 | 2.0 |
| S5 | 75.7 | 22.2 | 2.1 | 0.0 | 14.5 | 7.1 | 543 | 25.2 | 2.0 |
| S6 | 67.9 | 28.9 | 2.4 | Pearlite: 0.8 | 16.3 | 3.6 | 562 | 23.1 | 1.0 |
| S7 | 45.9 | 50.3 | 3.8 | 0.0 | 20.1 | 4.8 | 726 | 18.4 | 2.5 |
| S8 | 37.1 | 59.8 | 3.1 | 0.0 | 19.7 | 5.2 | 748 | 19.6 | 3.0 |
| S9 | 27.9 | 68.9 | 3.2 | 0.0 | 13.3 | 6.3 | 776 | 11.3 | 3.0 |
| S10 | 57.2 | 39.9 | 2.9 | 0.0 | 13.3 | 4.3 | 436 | 19.5 | 2.0 |
| S11 | 28.8 | 66.7 | 4.5 | 0.0 | 14.8 | 6.8 | 665 | 12.4 | 2.5 |
| S12 | 92.8 | 6.5 | 0.7 | 0.0 | 12.6 | 5.2 | 326 | 33.4 | 0.5 |
| S13 | 76.1 | 22.2 | 1.7 | 0.0 | 24.5 | 8.8 | 456 | 28.8 | 1.5 |
| $14 | 66.4 | 31.5 | 2.1 | 0.0 | 20.9 | 7.3 | 565 | 19.5 | 1.5 |
| S15 | 27.8 | 70.8 | 1.4 | 0.0 | 13.1 | 8.4 | 698 | 12.1 | 2.0 |
| S16 | 37.4 | 59.4 | 3.2 | 0.0 | 20.3 | 6.8 | 721 | 17.6 | 2.5 |
| S17 | 41.0 | 56.7 | 2.3 | 0.0 | 14.7 | 5.3 | 649 | 20.6 | 2.0 |
| S18 | 35.5 | 60.8 | 3.7 | 0.0 | 16.1 | 5.1 | 663 | 20.8 | 2.0 |
| S19 | 37.6 | 57.1 | 4.4 | Austenite: 0.9 | 31.3 | 6.8 | 736 | 15.9 | 3.0 |
| S20 | 70.4 | 27.8 | 1.8 | 0.0 | 23.3 | 15.3 | 572 | 26.1 | 2.0 |
| S21 | 60.7 | 36.7 | 2.6 | 0.0 | 21.5 | 11.6 | 583 | 24.7 | 2.0 |
| S22 | 73.9 | 23.8 | 2.3 | 0.0 | 28 | 14.8 | 509 | 25.1 | 2.5 |
| S23 | 70.6 | 27.2 | 2.2 | 0.0 | 21.3 | 13.3 | 543 | 26.4 | 2.0 |
| S24 | 68.7 | 29.2 | 2.1 | 0.0 | 29.6 | 16.3 | 552 | 27.3 | 3.0 |
| S25 | 72.7 | 25.7 | 1.6 | 0.0 | 28.6 | 12.9 | 537 | 25 | 2.5 |
| S26 | 66.4 | 31.1 | 2.5 | 0.0 | 37.6 | 8.2 | 567 | 28.1 | 3.5 |
| S27 | 68.3 | 30.4 | 1.3 | 0.0 | 7.3 | 3.9 | 529 | 29.4 | 1.0 |
| S28 | 33.3 | 63.5 | 3.2 | 0.0 | 19.3 | 10.6 | 754 | 16.8 | 2.5 |
| S29 | 65.8 | 31.8 | 2.4 | 0.0 | 7.7 | 4.1 | 537 | 24.9 | 2.0 |
| S30 | 70.3 | 27.7 | 2.0 | 0.0 | 36.7 | 6.4 | 501 | 27.6 | 4.0 |
| S31 | 43.1 | 53.1 | 3.8 | 0.0 | 15.3 | 10.6 | 642 | 23.2 | 2.5 |
| S32 | 77.6 | 20.3 | 2.1 | 0.0 | 38.1 | 6.9 | 537 | 24.5 | 3.5 |
| S33 | 26.7 | 69.1 | 4.2 | 0.0 | 15.6 | 7.6 | 776 | 10.6 | 3.0 |
| S34 | 26.3 | 71.1 | 2.6 | 0.0 | 21.5 | 5.2 | 783 | 11.4 | 3.0 |
| S35 | 32.5 | 61.2 | 6.3 | 0.0 | 15 | 4.8 | 744 | 16.4 | 3.5 |
| S36 | 37.3 | 61.4 | 1.3 | 0.0 | 29.3 | 16.3 | 529 | 26.3 | 2.0 |
| S37 | 68.7 | 29.6 | 1.7 | 0.0 | 22.4 | 14.9 | 530 | 24.1 | 1.0 |
| S38 | 63.1 | 34.8 | 2.1 | 0.0 | 21 | 11.6 | 547 | 23 | 1.0 |
| S39 | 62.0 | 36.4 | 1.6 | 0.0 | 34.1 | 13.4 | 449 | 30.6 | 1.5 |
| S40 | 40.7 | 55.9 | 3.4 | 0.0 | 30.7 | 12.9 | 568 | 20.8 | 1.5 |
| S41 | 70.3 | 27.4 | 2.3 | 0.0 | 20.3 | 13.4 | 569 | 22.1 | 1.0 |
| S42 | 69.8 | 27.5 | 2.7 | 0.0 | 18.7 | 11.6 | 553 | 27.7 | 2.0 |
| S43 | 64.0 | 35.0 | 1.0 | 0.0 | 10.9 | 8.0 | 531 | 19 | 2.0 |
| S44 | 96.3 | 3.3 | 0.2 | Pearlite: 0.2 | 22.3 | 5.8 | 560 | 24.3 | 1.0 |
| S45 | 89.8 | 9.4 | 0.3 | Pearlite: 0.5 | 19.6 | 4.8 | 567 | 21.8 | 1.0 |
| S46 | 74.1 | 25.0 | 0.9 | 0.0 | 18.2 | 8.9 | 541 | 18.3 | 2.5 |
| S47 | 98.9 | 1.1 | 0.0 | 0.0 | 22.3 | 9.8 | 430 | 25.1 | 1.0 |

In addition, from the obtained steel sheet coil, a ring test piece shown in FIG. 1 was collected by performing shear trimming (punching using a trimming die) centered on a ½ position, a ¼ position, and a ⅛ position of the steel sheet in the width direction, was subjected to a gas soft nitriding treatment in an atmosphere of a mixed gas containing 45% of nitrogen, 50% of ammonia, and 5% of carbon dioxide in terms of volume fraction. The gas soft nitriding treatment was performed at a treatment temperature of 570° C. for a soaking and holding time of 1 hour, and a shape change was investigated.

As described above, outer diameters in a rolling direction, in a direction perpendicular thereto, and in directions at 450 and 135° with respect to the rolling direction were measured before and after the treatment. A case where amounts of change in all the outer diameters were 1 mm or less was determined to be acceptable, and a case where an amount of change in any of the three positions was more than 1 mm was determined to be unacceptable.

In addition, a 15 cm square test piece was collected from the ½ position in the width direction of the steel sheet and was subjected to the gas soft nitriding treatment under the same conditions as described above. A pin-on-disk type flat plate wear test was conducted on the test piece after the gas soft nitriding treatment. A sliding speed of the friction test piece in the wear test was set to 1 μm/s, and a wear load was applied for 3 hours under conditions of a contact pressure of 1000 MPa, a room temperature, and no lubrication. Those having a thickness reduction of 300 μm or more after the test were determined to be unacceptable.

However, in a case where the strength or formability of a steel sheet for gas soft nitriding as a material did not satisfy the target value or the shape change due to the gas soft nitriding was large, the steel sheet for gas soft nitriding was not suitable for use as a gas-soft nitrided component, and the wear test was not conducted.

The results are shown in Table 4.

TABLE 4

| | After gas soft nitriding treatment | | | | |
|---|---|---|---|---|---|
| Test No. | Amount of shape change | Surface layer hardness Hv | Effective hardening depth mm | Wear resistance | Note |
| S1 | Acceptable | 484 | 0.315 | Unacceptable | Comparative Example |
| S2 | Acceptable | 614 | 0.308 | Unacceptable | Comparative Example |
| S3 | Acceptable | 525 | 0.321 | Not conducted*1 | Comparative Example |
| S4 | Acceptable | 563 | 0.318 | Acceptable | Invention Example |
| S5 | Acceptable | 572 | 0.309 | Acceptable | Invention Example |
| S6 | Acceptable | 541 | 0.345 | Acceptable | Invention Example |
| S7 | Acceptable | 662 | 0.336 | Unacceptable | Comparative Example |
| S8 | Acceptable | 540 | 0.384 | Unacceptable | Comparative Example |
| S9 | Acceptable | 601 | 0.327 | Not conducted*1 | Comparative Example |
| S10 | Acceptable | 701 | 0.260 | Unacceptable | Comparative Example |
| S11 | Acceptable | 742 | 0.310 | Not conducted*1 | Comparative Example |
| S12 | Acceptable | 620 | 0.311 | Not conducted*1 | Comparative Example |
| S13 | Acceptable | 540 | 0.346 | Acceptable | Invention Example |
| S14 | Acceptable | 521 | 0.329 | Acceptable | Invention Example |
| S15 | Acceptable | 599 | 0.337 | Not conducted*1 | Comparative Example |
| S16 | Acceptable | 620 | 0.316 | Acceptable | Invention Example |
| S17 | Acceptable | 734 | 0.345 | Acceptable | Invention Example |
| S18 | Acceptable | 641 | 0.352 | Acceptable | Invention Example |
| S19 | Acceptable | 683 | 0.343 | Acceptable | Invention Example |
| S20 | Unacceptable | 576 | 0.306 | Not conducted*2 | Comparative Example |
| S21 | Unacceptable | 540 | 0.349 | Not conducted*2 | Comparative Example |
| S22 | Unacceptable | 535 | 0.362 | Not conducted*2 | Comparative Example |
| S23 | Unacceptable | 520 | 0.327 | Not conducted*2 | Comparative Example |
| S24 | Unacceptable | 549 | 0.311 | Not conducted*2 | Comparative Example |
| S25 | Unacceptable | 568 | 0.332 | Not conducted*2 | Comparative Example |
| S26 | Acceptable | 545 | 0.321 | Not conducted*1 | Comparative Example |
| S27 | Acceptable | 545 | 0.279 | Unacceptable | Comparative Example |
| S28 | Unacceptable | 609 | 0.334 | Not conducted*2 | Comparative Example |
| S29 | Acceptable | 531 | 0.203 | Unacceptable | Comparative Example |
| S30 | Acceptable | 557 | 0.310 | Not conducted*1 | Comparative Example |
| S31 | Unacceptable | 649 | 0.327 | Not conducted*2 | Comparative Example |
| S32 | Acceptable | 527 | 0.353 | Not conducted*1 | Comparative Example |
| S33 | Acceptable | 736 | 0.337 | Not conducted*1 | Comparative Example |
| S34 | Acceptable | 751 | 0.329 | Not conducted*1 | Comparative Example |
| S35 | Acceptable | 734 | 0.313 | Not conducted*1 | Comparative Example |
| S36 | Unacceptable | 522 | 0.329 | Not conducted*2 | Comparative Example |
| S37 | Unacceptable | 563 | 0.356 | Not conducted*2 | Comparative Example |
| S38 | Unacceptable | 578 | 0.361 | Not conducted*2 | Comparative Example |
| S39 | Unacceptable | 520 | 0.342 | Not conducted*2 | Comparative Example |
| S40 | Unacceptable | 556 | 0.337 | Not conducted*2 | Comparative Example |
| S41 | Unacceptable | 528 | 0.349 | Not conducted*2 | Comparative Example |
| S42 | Unacceptable | 546 | 0.316 | Not conducted*2 | Comparative Example |
| S43 | Acceptable | 552 | 0.309 | Acceptable | Invention Example |
| S44 | Acceptable | 598 | 0.321 | Acceptable | Invention Example |
| S45 | Acceptable | 555 | 0.333 | Acceptable | Invention Example |
| S46 | Acceptable | 568 | 0.341 | Acceptable | Invention Example |
| S47 | Acceptable | 620 | 0.372 | Acceptable | Invention Example |

*1 Since the strength or elongation (formability) of the steel sheet was insufficient, the wear test was not conducted

*2 Since a shape change due to the gas soft nitriding treatment was large, the wear test was not conducted As can be seen from Tables 1 to 4, in Test Nos. S4 to S6, S13, S14, S16 to S19, and S43 to S47 as invention examples, the steel sheets for gas soft nitriding had sufficient tensile strength, elongation, and bendability, and had a small shape change due to the gas soft nitriding treatment. In addition, among these, in the steel sheets after the gas soft nitriding treatment (corresponding to the gas-soft nitrided components), the surface layer hardness was 500 Hv or more, and the effective hardening depth, which is a depth with a hardness higher by 50 Hv or more than that of the primary phase, was 0.300 mm or more. As a result, the steel sheets after the gas soft nitriding treatment was also excellent in wear resistance.

On the other hand, in S1 to S3, S7 to S12, and S15 in which the chemical composition was outside of the range of the present invention, and in S20 to S42 in which the manufacturing conditions were not preferable, in the steel sheets for gas soft nitriding, any of the tensile strength, elongation, and bendability was insufficient, the shape change due to the gas soft nitriding treatment was large, or the wear resistance after the gas soft nitriding treatment was low.

INDUSTRIAL APPLICABILITY

According to the present invention, it is possible to provide a steel sheet for gas soft nitriding capable of reducing an amount of shape change in a case where a gas soft nitriding treatment is performed as a surface-hardening treatment on the premise that generally required tensile strength, elongation, and bendability are provided. Therefore, high industrial applicability is achieved.

What is claimed is:

1. A steel sheet for gas soft nitriding comprising, as a chemical composition, by mass %:

C: 0.02% to 0.10%;
Si: 0.001% to 0.100%;
Mn: 0.70% to 1.65%;
P: 0.060% or less;
S: 0.005% or less;
sol. Al: 0.020% to 0.450%;
Ti: 0.020% to 0.120%;
Cr: 0.100% to 0.450%;
N: 0.0003% to 0.0070%;
Cu: 0% to 0.40%;
Ni: 0% to 0.30%;
Nb: 0% to 0.080%;
V: 0% to 0.080%;
Mo: 0% to 0.100%;
B: 0% to 0.0020%;
Ca: 0% to 0.0100%;
REM: 0% to 0.0100%;
Sn: 0% to 0.0300%;
Sb: 0% to 0.0100%;
As: 0% to 0.0100%;
Mg: 0% to 0.0300%; and
a remainder including Fe and impurities, wherein Formulas (1) and (2) are satisfied, a metallographic structure of the steel sheet for gas soft nitriding contains, by area %,
ferrite: 30.0% to 100.0%,
martensite: 0% to 5.0%,
bainite: 0% to 70.0%,
retained austenite: 0% to 3.0%, and
pearlite: 0% to 3.0%, when a sheet thickness is indicated as t, a sheet width, which is a width in a direction perpendicular to a rolling direction, is indicated as w, and effective grain sizes are measured at seven positions of w/8, w/4, 3w/8, w/2, 5w/8, 3w/4, and 7w/8 in a width direction from an end portion in the width direction at a t/4 depth position from a surface, an average effective grain size, which is an average of the effective grain sizes at the seven positions, is 8.0 to 35.0 μm, and an effective grain size difference, which is a difference between a maximum value and a minimum value among the effective grain sizes at the seven positions, is 10.0 μm or less, $$[\text{sol. Al}]+[\text{Cr}]\leq 0.482 \quad \text{Formula (1)}$$

$$94<64\times[\text{Mn}]+156\times[\text{Cr}]+190\times[\text{sol. Al}]-9\times[\text{Mn}]^2-86\times[\text{Cr}]^2-328\times[\text{sol. Al}]^2 \quad \text{Formula (2)}$$

where [element symbol] is an amount of an element represented by the element symbol by mass %.

2. The steel sheet for gas soft nitriding according to claim 1, wherein the steel sheet for gas soft nitriding contains, as the chemical composition, by mass %, one or more of:
Cu: 0.01% to 0.40%;
Ni: 0.01% to 0.30%;
Nb: 0.001% to 0.080%;
V: 0.001% to 0.080%;
Mo: 0.001% to 0.100%;
B: 0.0001% to 0.0020%;
Ca: 0.0001% to 0.0100%;
REM: 0.0001% to 0.0100%;
Sn: 0.0001% to 0.0300%;
Sb: 0.0001% to 0.0100%;
As: 0.0001% to 0.0100%; and
Mg: 0.0001% to 0.0300%.

3. The steel sheet for gas soft nitriding according to claim 1, wherein a No. 5 test piece according to JIS Z 2241:2011 has a tensile strength of 370 MPa or more and an elongation of 13.0% or more.

* * * * *